United States Patent [19]

Adams

[11] 4,086,735

[45] May 2, 1978

[54] SOIL ANCHOR

[76] Inventor: Ray Adams, 1450 S. Manhattan Ave., Fullerton, Calif. 92631

[21] Appl. No.: 801,913

[22] Filed: May 31, 1977

[51] Int. Cl.[2] ..... E02D 5/80
[52] U.S. Cl. ..... 52/160; 61/53.68
[58] Field of Search ..... 61/53.58, 53.68, 53.6; 52/160, 156

[56] References Cited

U.S. PATENT DOCUMENTS

| | | | |
|---|---|---|---|
| 904,198 | 11/1908 | Haase | 52/160 |
| 958,127 | 5/1910 | Hovrud | 52/160 |
| 1,370,334 | 3/1921 | Manderfeld | 52/160 |
| 3,526,069 | 9/1970 | Deike | 61/53.68 X |

FOREIGN PATENT DOCUMENTS

| | | | |
|---|---|---|---|
| 306,186 | 2/1929 | United Kingdom | 52/159 |

*Primary Examiner*—Dennis L. Taylor
*Attorney, Agent, or Firm*—Allen A. Dicke, Jr.

[57] ABSTRACT

Soil anchor has a square drive tube which is driven into the soil. A point crimped onto the drive tube aids in driving and prevents soil entry into the drive tube. When the tube is in place in the soil, two anchor straps are driven down through the tube and past curved guides at the front of the tube on the back of the point which cause the anchor straps to bend to laterally enter the soil for anchoring. A channel-shaped mounting bracket bolted to the top of the drive tube permits the attachment of any device that needs to be anchored and supported; for example, the support post of an aluminum patio roof.

5 Claims, 6 Drawing Figures

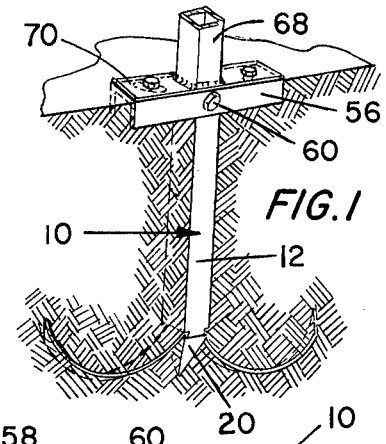
FIG. 1
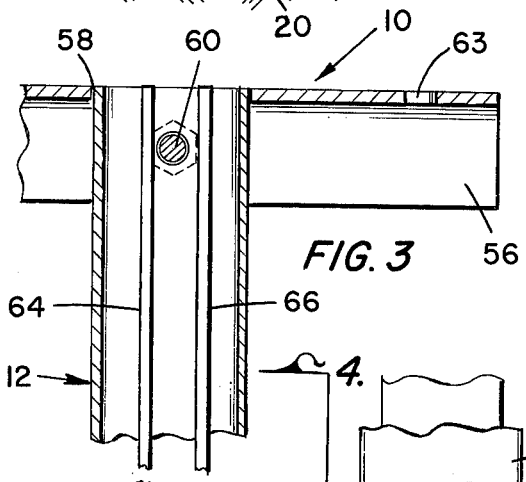
FIG. 3
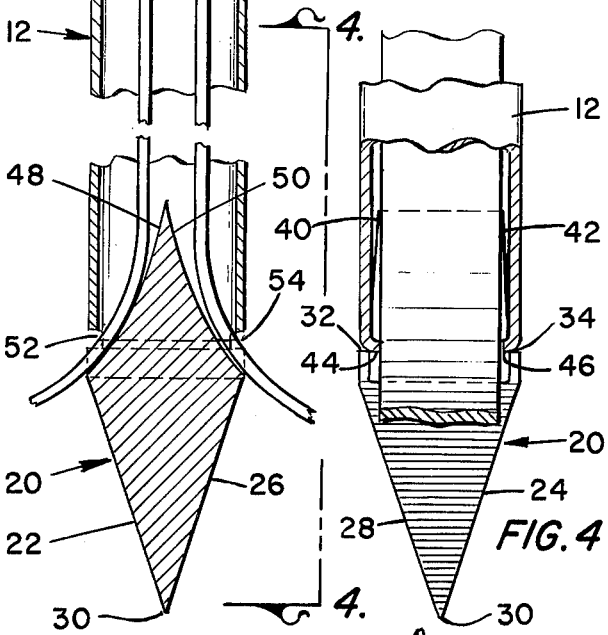
FIG. 4
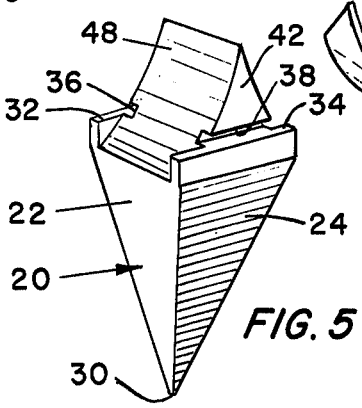
FIG. 5
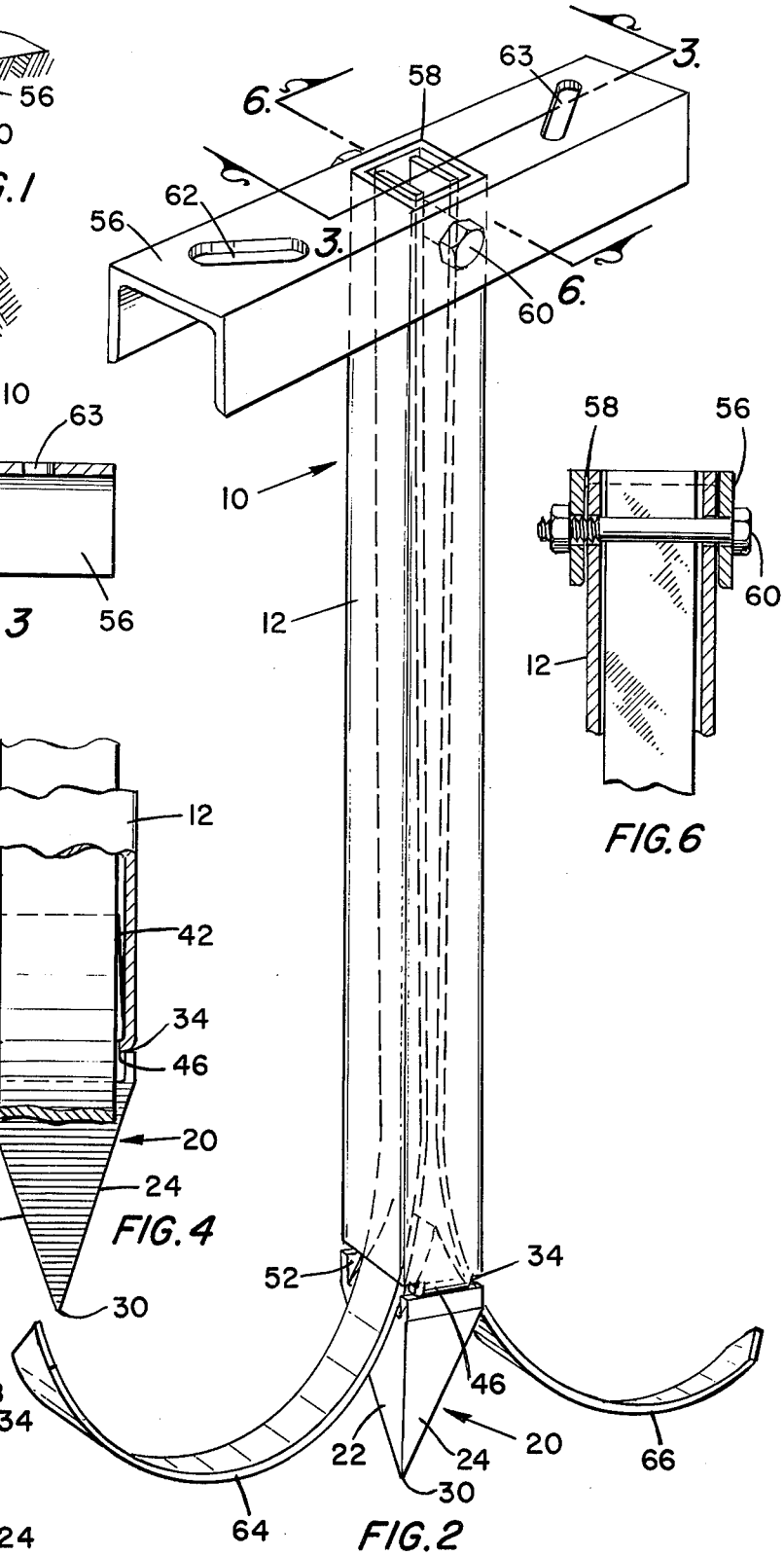
FIG. 2
FIG. 6

SOIL ANCHOR

BACKGROUND

This invention is directed to a soil anchor for anchoring and supporting equipment with respect to the soil.

Many soil anchors are known, and the best common patio roof anchor comprises the underground burying of a rectangular plate with backfill and tamping of the soil. The size of the plate is important, because the pull-out strength is directly related to the size; however since the soil is disturbed in the excavation and burying of the plate, full soil strength is not achieved so that anchor strength is not maximized.

Another type of known soil anchor is screwed into the soil like an auger. Its helical anchor surfaces engage in a column of soil which, unfortunately, is disturbed when the anchor is screwed in. In connection with the auger type screw anchor, it is necessary to note that the diameter of the auger determines both the area of the column of soil which holds down the anchor and also the torque necessary to screw the anchor into the soil. As anchoring capability increases, so does the torque necessary to insert the anchor so that large, special machinery is required to insert anchors having adequate strength for many installations. Thus, there is need for an anchor that can be readily installed with ordinary tools and yet provide support and pullout strength which is adequate for many purposes.

SUMMARY

In order to aid in the understanding of this invention, it can be stated in essentially summary form that it is directed to a soil anchor comprising a drive tube for driving into the ground with a point crimped into the lower, forward end thereof. After the drive tube is installed, an anchor strap is driven down through the tube with the anchor strap engaging a curved guide surface on the back of the point which bends the anchor strap laterally so that it laterally enters the soil to anchor the drive tube and the anchor strap in the ground.

It is thus an object of this invention to provide a soil anchor which can be readily installed with ordinary tools and which provides a maximized anchoring capability. It is another object to provide a soil anchor which does not disturb the soil above the area in which anchoring occurs. It is a further object to provide a soil anchor which provides for an anchor strap which laterally enters the soil at the anchor point without need for excavation to bury the soil anchor. It is another object to provide a soil anchor which is economic of manufacture and of ready trouble-free use so that it can be widely employed.

Other objects and advantages of this invention will become apparent from a study of the following portion of the specification, the claims, and the attached drawings.

BRIEF DESCRIPTION OF THE DRAWINGS

FIG. 1 is an isometric view of the soil anchor of this invention shown installed in the soil with the soil being shown in section.

FIG. 2 is an enlarged isometric view of the soil anchor.

FIG. 3 is an enlarged section, with parts broken away, taken generally along the line 3—3, of FIG. 2.

FIG. 4 is an enlarged section, with parts broken away, taken generally along the line 4—4 of FIG. 3.

FIG. 5 is an isometric view of the point.

FIG. 6 is a section taken generally along the line 6—6 of FIG. 2.

DESCRIPTION

The soil anchor of this invention is generally indicated at 10 in FIGS. 1, 2 and 3. Its principal upright member is drive tube 12 which is a square, galvanized steel tubing. The lower end of drive tube 12 carries point 20, see FIGS. 2, 3, 4 and 5. Point 20 has four entering surfaces 22, 24, 26 and 28 which form a regular square pyramid having an acute angle at point 30. Point 30 is thus relatively sharp to ease the entry into the ground.

Point 20 carries stop shoulders 32 and 34 thereon against which the lower front edge of drive tube 12 abuts. Grooves 36 and 38 are located adjacent to the stop shoulders. Above the grooves, sidewalls 40 and 42 (see FIGS. 4 and 5) are tapered so that, when the square drive tube is fitted over point 20, the point is received in the drive tube in a friction fit. When positioned, the lower edges of the drive tube walls are crimped into grooves 36 and 38. The crimps 44 and 46 are shown in FIG. 4.

The other upper surfaces of the point inside of the drive tube define guide surfaces 48 and 50, see FIGS. 3 and 5. Guide surfaces 48 and 50 join in a straight edge inside of the drive tube and are concavely curved. The guide surfaces are positioned below the stop shoulders on the point, see FIGS. 2, 3 and 5, so that openings 52 and 54 are left below the bottom edge of the guide tube. This construction is such that tube 12 can be galvanized and point 20 can be assembled thereto by friction fit and crimping so that welding is not necessary. If welding is done on a galvanized structure, then the protection of the galvanizing is destroyed adjacent the weld area, unless post-weld galvanizing is practiced. Such a subsequent step is uneconomic.

Cap 56, see FIGS. 1, 2, 3 and 6, is the form of the channel having its flanges sufficiently separated to embrace around drive tube 12. Opening 58 in the center of the flange of cap 56 is of the same size as the outside of drive tube 12 to admit the top of the drive tube, see FIGS. 2, 3 and 6. Bolt 60 passes through the flanges of the cap and through the top of the drive tube to hold the cap in place. The single bolt is sufficient to achieve secure fastening in view of the fact that the top of the drive tube is in opening 58. The structure is such that, during shipping with bolt 60 removed, the cap can lie embraced along the length of guide tube 12 to occupy minimum shipping space. Furthermore, no welding is necessary for the attachment of the cap so that the galvanizing protection is not inhibited. The cap is also preferably galvanized steel. Cap 56 has securement slots 62 and 63 therein so that canopy support 68 may be secured thereto.

In use, drive tube 12 is first driven into the ground so that its cap 56 is at an appropriate position, usually at ground level. After being driven into the ground, anchor straps 64 and 66 are installed. They start as straight steel straps with angularly cut front ends, and they are lowered down through drive tube 12 until they engage upon the guide surfaces 48 and 50, respectively. The guide surfaces are outwardly curved and directed, and with the anchor straps resting thereon, the anchor straps are driven downward. As the straps are driven downward, they are bent outward by engagement on the guide surfaces 48 and 50. They are driven downward until the upper end is flush with the top of cap 56 so that the anchor straps are out of the way. The lower end of the anchor straps form curved anchor flukes as they are progressively bent as they are driven downward across the guide surfaces and out the adjacent openings 52 and 54. The curved anchor flukes are thus embedded in the soil without disturbing the soil above them.

Soil anchor 10 is now ready for the attachment of the device to be supported. For example, canopy support 68 has foot 70 which is bolted down on the top of cap 56. The canopy support may be for an aluminum awning type canopy such as is often found in connection with mobile homes, or may be other similar types of structures. Furthermore, soil anchor 10 is useful in any application where a firm anchor into undisturbed soil is required.

In a particular preferred embodiment, drive tube is a 1½ inch by 1½ inch outside by 0.095 inch wall galvanized welded steel tube with a 1½ inch by 1½ inch inside galvanized channel. The length of drive tube 12 is 24 inches. Anchor straps 64 and 66 are 1¼ by ⅛ galvanized hot rolled steel straps about 34 inches long with the front edge cut at 30°. A soil anchor of this type had its drive tube driven into a tilled flower bed of moist earth with the anchor straps driven after the drive tube was in place. A pull test showed an anchor strength of in excess of 1,500 pounds to start the anchor moving upward out of the ground and a strength in excess of 2,100 pounds maximum anchor strength in these particular conditions. Thus, an anchor of this design and of moderate size has considerable strength.

The invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A soil anchor comprising:

an elongated rectangular galvanized steel drive tube having a rectangular opening therethrough extending generally along the length thereof;

elongated attachment means detachably secured to the upper end of said drive tube for the attachment of a canopy support to said drive tube;

a point secured on the bottom end of said drive tube, said point being comprised of a block of ferrous material having crimping grooves therein, said drive tube being crimped into said crimping grooves on said point so that said point is secured to said drive tube, said point having shoulders thereon, the forward end of said drive tube resting against said shoulders so that driving force down the drive tube is transmitted to said point on said shoulders, said point having a forwardly directed pointed end to serve as the pointed end for said tube as said soil anchor is driven into the soil;

said point having two guide surfaces opposite each other thereon and an opening slot between each of said guide surfaces and the forward end of said drive tube, said point extending into said drive tube so that a portion of each of said guide surfaces is within said guide tube, said point adjacent said guide surface being tapered to frictionally engage within the forward end of said drive tube; and two anchor straps for positioning in said opening through said tubular drive, each of said anchor straps being for positioning against one of said guide surfaces and out of one of said lateral openings in said drive tube for anchoring in soil.

2. The soil anchor of claim 1 wherein said crimping slots are adjacent said shoulders so that a portion of the forward end of said guide tube is crimped into said crimping slot and a portion rests against said shoulders.

3. The soil anchor of claim 2 wherein said guide surface is concavely curved.

4. The soil anchor of claim 1 wherein said attachment means secured to the upper end of said drive tube is a channel having its flanges embracing said drive tube, and an opening in the web of said channel with the upper end of said drive tube in said opening.

5. The soil anchor of claim 4 wherein a removable through fastener extends through said flanges and the upper end of said guide tube to detachably secure said channel to the upper end of said guide tube.

* * * * *